United States Patent [19]

Higami

[11] Patent Number: 4,577,858

[45] Date of Patent: Mar. 25, 1986

[54] FINGERTIP EXERCISER

[76] Inventor: Masanobu Higami, 14-10 2-chome, Takarazuka-shi, Asahi-machi, Hyogo-ken, Japan

[21] Appl. No.: 646,808

[22] Filed: Sep. 4, 1984

[51] Int. Cl.[4] ..... A63B 23/00

[52] U.S. Cl. ..... 272/67; 128/26; 128/57

[58] Field of Search ..... 272/67, 68, 94–96, 272/145, 900, 127; 128/57, 26; 446/121; 84/465, 467

[56] References Cited

U.S. PATENT DOCUMENTS

| | | | |
|---|---|---|---|
| 1,014,774 | 1/1912 | Rohrer | 128/57 |
| 2,219,138 | 10/1940 | Morrison | 128/26 |
| 2,246,263 | 6/1941 | Patterson | 128/57 |
| 2,310,804 | 2/1943 | Morrison | 128/26 |
| 3,037,500 | 6/1962 | Daugherty | 272/96 |
| 3,779,548 | 12/1973 | Sato | 272/67 |

FOREIGN PATENT DOCUMENTS

| | | | |
|---|---|---|---|
| 345944 | 11/1921 | Fed. Rep. of Germany | 272/68 |

*Primary Examiner*—Richard J. Apley
*Assistant Examiner*—S. R. Crow
*Attorney, Agent, or Firm*—George B. Oujevolk

[57] ABSTRACT

A fingertip exerciser comprising two balls each having a bore extending centrally therethrough and a connector inserted through the bores of the balls and rotatably connecting the balls together. The faculty of the fingertips can be developed by rotating the two balls with the fingertips.

1 Claim, 2 Drawing Figures

FINGERTIP EXERCISER

BACKGROUND OF THE INVENTION

The present invention relates to a fingertip exerciser, and more particularly to a device comprising two balls which are rotatable by the fingertips for exercising the fingertips for the development of their faculty.

Generally the fingertips must be more flexible than the other parts of the body. It is known that exercise of the fingertips is also effective for developing the brain because the fingertips have many peripheral nerves collected therein.

While devices of various constructions have heretofore been developed for exercising the fingertips, they are no very effective for developing the faculty of the fingertips for the complexity of the structure and high price.

SUMMARY OF THE INVENTION

The main object of the present invention is to overcome the drawback of such conventional fingertip exercising devices.

More specifically, a first object of the present invention is to provide an improved fingertip exerciser which is very simple in construction and easy and inexpensive to make.

A second object of the invention is to provide an improved fingertip exerciser which is very small, lightweight and portable.

A third object of the invention is to provide an improved fingertip exerciser which is useful for easy and effective exercise of the fingertips to magicians or musical instrument players who need such exercise, to those having a manual functional disorder and to children and other persons intending to develop their brain.

To fulfill these objects, the present invention provides a fingertip exerciser comprising two balls each having a bore extending centrally therethrough and a connector inserted through the bores of the balls and rotatably connecting the balls together.

According to a preferred feature of the invention, the outer peripheral surface of each ball can be formed with a multiplicity of indentations or projections.

The fingertips can then be exercised more efficiently by stimulating the peripheral nerves of the fingertips more effectively and assuring improved blood circulation.

According to another preferred feature of the invention, the ball can be composed of two divided segments made of a rigid synthetic resin.

It is then possible to make balls from semispherical segments which can be molded with use of an inexpensive mold and which can be formed with indentations or projections on the outer peripheral surface with ease.

Further according to another preferred feature of the invention, the balls can be made of a soft synthetic resin, rubber or the like.

The balls are then deformable while being continuously rotated, enabling the user to develop an increased grasping power.

These and other objects and features of the invention will be understood from the following detailed description and the accompanying drawings.

DETAILED DESCRIPTION OF THE INVENTION

Figure 1:
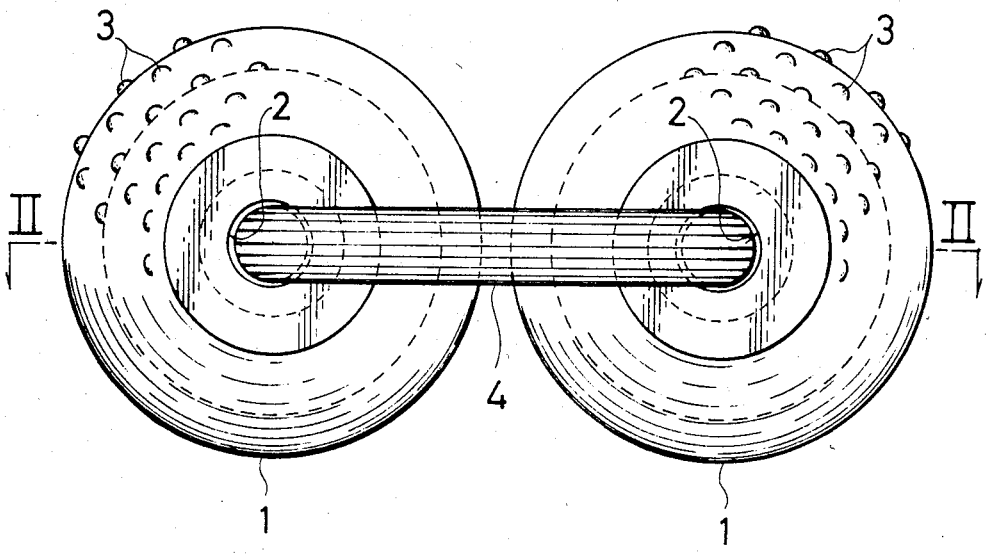
FIG. 1 is an enlarged front view showing a fingertip exerciser embodying the invention.
Figure 2:
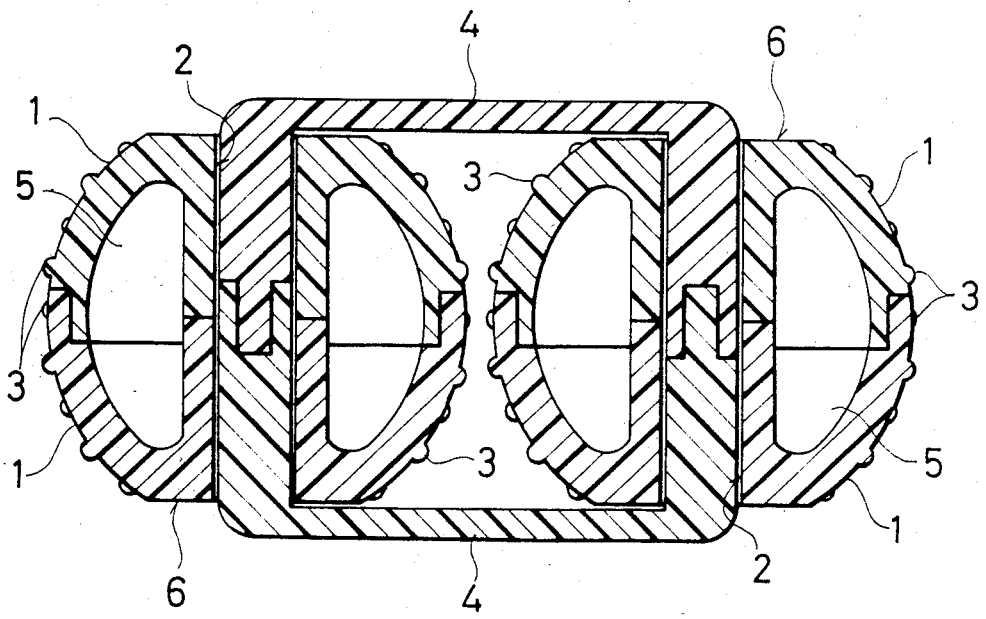
FIG. 2 is a view in section taken along the line II—II in FIG. 1.

A fingertip exerciser embodying the present invention will now be described in detail with reference to the accompanying drawings.

Balls 1 made of a synthetic resin each have a bore 2 extending centrally therethrough and an outer peripheral surface formed with a multiplicity of projections 3 at the portion thereof to be in contact with the fingers. Each ball 1 has a hollow portion 5 to reduce the amount of the material and the weight.

The ball 1 is formed by molding two semispherical segments and forcibly fitting or adhering them to each other into a single body.

To render the ball 1 smaller, a planar portion 6 is formed at each opening of the bore 2.

A connector 4 made of a synthetic resin or the like is inserted through the bores 2, 2 of the two balls 1, 1 for rotatably connecting the balls 1, 1 together.

The connector 4 comprises a pair of substantially U-shaped bars each having a tenon at its one end and a mortise at the other end thereof. The bars are joined together into an annular form by adhering or forcibly fitting their opposed ends to each other within the bores 2, 2 of the balls 1, 1.

To render the connector 4 small-sized, the connector 4 is flat except at the portions thereof extending through the bores 2, 2 of the balls 1, 1.

When to be used, the exerciser of the foregoing construction is placed on the palm, and the two balls are alternately rotated with the five fingers.

As already described, the exerciser of the present invention enables anyone to exercise their fingertips easily and inexpensively to make the finters flexible, assure smooth blood circulation and restore the desired faculty. Furthermore, the present device, which stimulates the peripheral nervous system, is also effective for the development of the brain for children and for the relief of stress.

Although the present invention has been described above with reference to the specific embodiment shown, it is to be understood that the invention can be otherwise modified within the scope of the appended claims.

For example, the ball needs only to be such that it is rotatable by the fingers, so that the connector may be in frictional contact with the bored portion of the ball to accommodate the difference in torque between the adult and the child.

The connector need not always be annular but may be adapted to connect the balls together at only one side thereof. Furthermore, the projections or indentations may be linear or in the form of a lattice.

What is claimed is:

1. A fingertip exerciser, comprising in combination:

(a) a synthetic resin pair of deformable balls (1), each ball having a bore (2) extending centrally therethrough and an outer peripheral ball surface where the portion of the ball surface surrounding each end of the bore is a planar surface, each ball of said pair being formed of two hollow hemispheres force fitted one onto the other with a vacant chamber (5) therein;

(b) a multiplicity of rounded projections (3) on said peripheral surface; and, (c) a connector (4) comprising a pair of U-shaped bars, each having a tenor at one end and a mortice at the other end, the bars being joined together into a rectangular shape to form said connector, the outer ends being force fitted one into the other within the bores of each ball, wherein the connector and bores are sized so as to permit the balls to be deformable while being rotated.

* * * * *